US005719361A

United States Patent [19]

Lee

[11] Patent Number: 5,719,361

[45] Date of Patent: Feb. 17, 1998

[54] MECHANISM FOR MULTIPLE DOME DUAL DETENT

[75] Inventor: James Sungioun Lee, Niles, Ohio

[73] Assignee: Packard Hughes Interconnect Company, Irvine, Calif.

[21] Appl. No.: 694,586

[22] Filed: Aug. 9, 1996

[51] Int. Cl.[6] ..... H01H 9/00; H01H 9/26; H01H 13/00; H01H 1/10

[52] U.S. Cl. ..... 200/1 B; 200/5 R; 200/339; 200/513

[58] Field of Search ..... 200/1 B, 5 A, 200/5 R, 275–277.2, 339, 512–517, 557

[56] References Cited

U.S. PATENT DOCUMENTS

| | | | |
|---|---|---|---|
| 4,081,632 | 3/1978 | Schaffeler | 200/6 BB |
| 5,412,164 | 5/1995 | Conway et al. | 200/1 B |
| 5,426,275 | 6/1995 | Maeda et al. | 200/553 |
| 5,430,261 | 7/1995 | Malone | 200/1 B |
| 5,510,583 | 4/1996 | Pescetto | 200/1 B |
| 5,559,311 | 9/1996 | Gorbatoff | 200/513 |
| 5,622,254 | 4/1997 | Lee | 200/557 |

FOREIGN PATENT DOCUMENTS

| | | | |
|---|---|---|---|
| 402 040 820 A | 2/1990 | Japan | 200/1 B |

*Primary Examiner*—Michael L. Gellner
*Assistant Examiner*—Michael J. Hayes
*Attorney, Agent, or Firm*—Cary W. Brooks

[57] ABSTRACT

The invention includes a mechanism for multi-dome switch having first, second, third and fourth collapsible dome structures. An elongated action bar extends across and bridges a pair of collapsible dome structures. The action bar, each have a top surface and a bottom surface. A notch is formed in the top surface closer to one of the dome structures. Engagement nubs extend downwardly from the bottom surface of the action bar near both ends and are positioned to be received in a respective depression formed on the top surface of the collapsible dome. A switch pedal is positioned for pivotal movement between a first and second forward positions, and a first and second backward (rear) positions.

8 Claims, 4 Drawing Sheets

MECHANISM FOR MULTIPLE DOME DUAL DETENT

FIELD OF THE INVENTION

This invention relates to switches utilizing collapsible domes.

BACKGROUND OF THE INVENTION

A variety of switches using collapsible domes are known. Maeda et al, U.S. Pat. No. 5,426,275, issued Jun. 20, 1995, the disclosure of which is hereby incorporated by reference, describes a seesaw switch including an action bar bridging first and second elastic click members. The elastic click members have flat tops and carry a movable contact positioned under the tops and over a fixed contact. A keycap is pivotably positioned over the action bar and includes a first sharp projection contacting the action bar near the first elastic click member, and a second sharp projection contacting the action bar near the second elastic click member. The action bar may be pivoted a first angular amount in a clockwise direction, causing the action bar to rotate with respect to the second elastic member to buckle the first click member. Further pivoting the keycap in a clockwise direction causes the action bar to rotate with respect to the buckled first elastic member, thereby buckling the second elastic click member. Similarly when the action bar is pivoted a first amount in a counterclockwise direction, the second click member is buckled, and further pivoting the action bar subsequently causes the first elastic click member to buckle. Thus, the system provides a four-position switch using two elastic click members.

However, it has been discovered that such a system has a variety of disadvantages. Asymmetric loading of the sharp projections of the keycap induces tilting of the action bar in multiple planes. Further, the action bar is susceptible to linear movement with respect to the two elastic click members. As a result of these susceptibilities, the switch system is subject to variable dual detent feel during its operation life. Further, a reduction in the difference in the magnitude of the force required to collapse the first and second elastic click members, or possibly complete failure of the switch, may result from substantial movement of the action bar.

The present invention provides advantages over the prior art.

SUMMARY OF THE INVENTION

The invention includes a mechanism for multi-dome switch having first, second, third and fourth collapsible dome structures. The dome structures have a relatively thick annular ring member and a center membrane underneath the annular ring member. A wall extends downward from the annular ring to complete the dome structure. The annular ring and membrane defining a depression in the top surface of the dome. An elongated action bar extends across and bridges a pair of collapsible dome structures. The action bars each have a top surface and a bottom surface. A notch is formed in the top surface closer to one of the dome structures. Engagement nubs extend downwardly from the bottom surface of the action bar near both ends and are positioned to be received in a respective depression formed on the top surface of the collapsible dome. A switch pedal is positioned for pivotal movement between a first and second forward positions, and a first and second backward (rear) positions. The movement of the switch pedal is in a direction perpendicular to the longitudinal axis of the action bar. The switch pedal includes an engagement bar extending downwardly near one end and positioned to be received in the notch formed in the top surface of the action bar.

When the pedal is rotated forward to a first position, the engagement bar forces the first action bar to rotate in a direction towards the first collapsible dome structure causing the structure to collapse. Movement of the pedal still further forward causes the first action bar to rotate towards the second dome member collapsing the same.

When the pedal is rotated in the opposite to a third position, the engagement bar forces the second action bar to rotate in a direction towards the third collapsible dome structure causing the structure to collapse. Movement of the pedal still further forward causes the second action bar to rotate towards the fourth dome member collapsing the same.

The downwardly extending nubs from the action bar being received in the depression of the dome holds the action bar in a fixed relationship throughout the life of the switch. Likewise, the downwardly extending engagement bar of the pedal being received in the notch of the action bar fixes the location of the action bar and prevents the same from any tilting or movement due to asymmetrical loading.

These and other objects, features, and advantages of the present invention will become apparent from the following brief description of the drawings, detailed description and appended claims and drawings.

DERAILED DESCRIPTION

Figure 1:
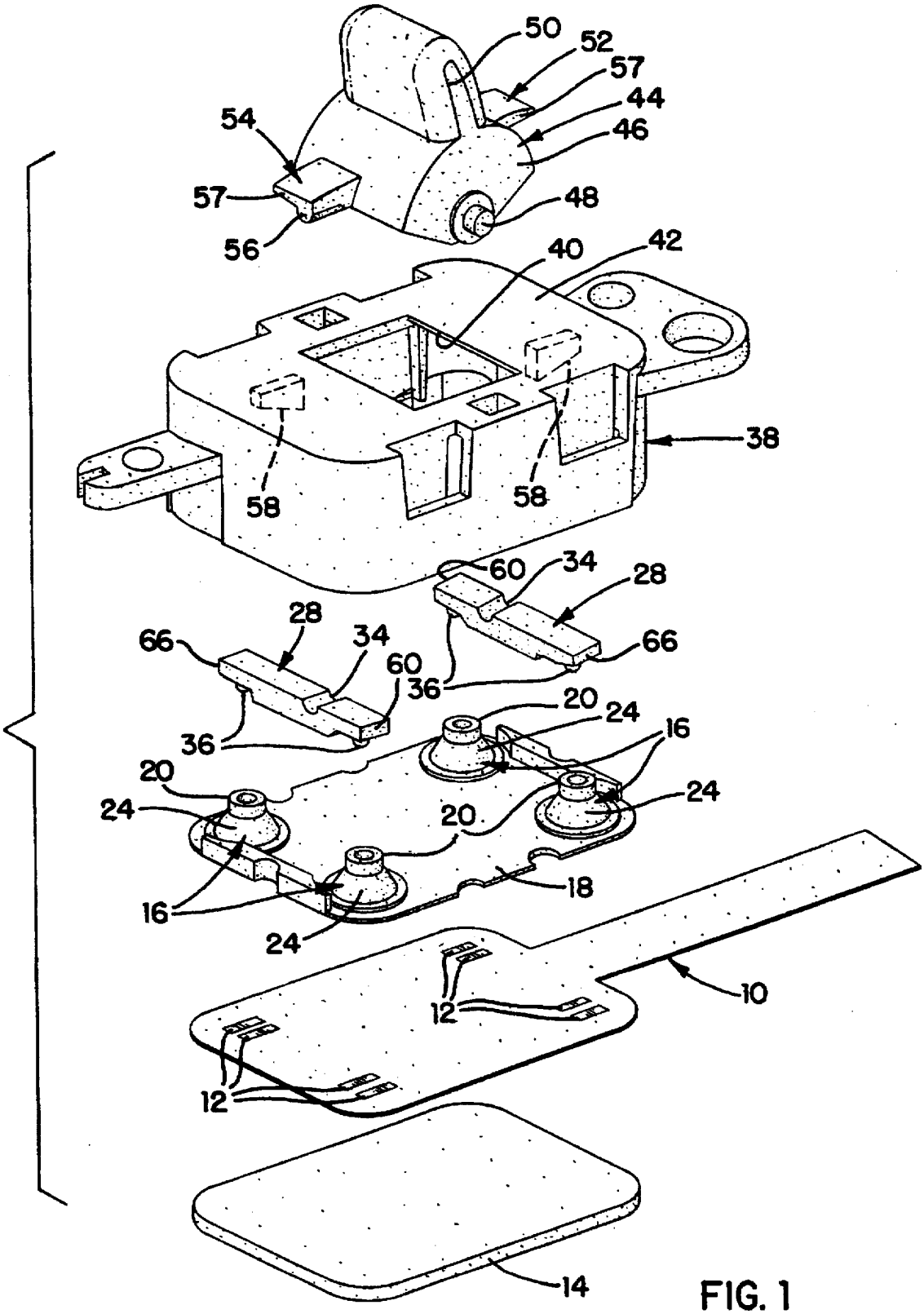
FIG. 1 illustrates an exploded view of a switch mechanism according to the present invention.
Figure 2:
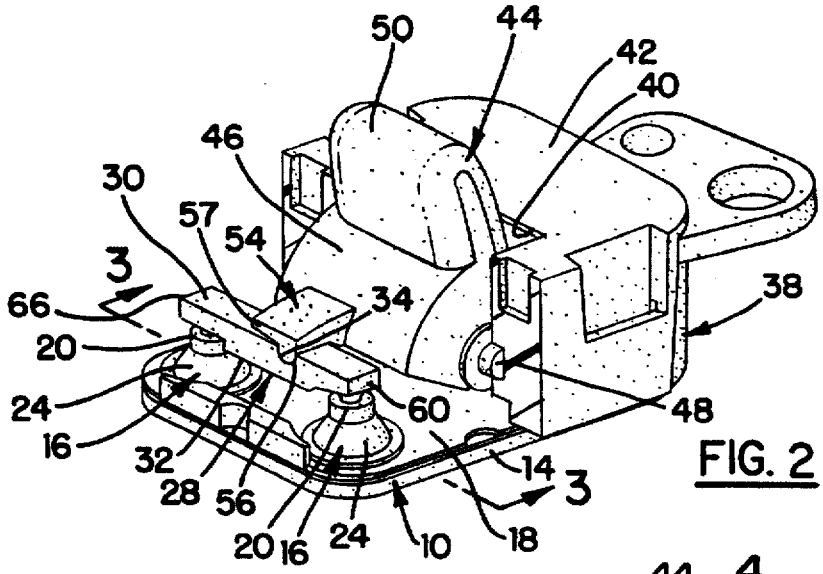
FIG. 2 is a perspective view with portions broken away of a switch according to the present invention.
Figure 3:
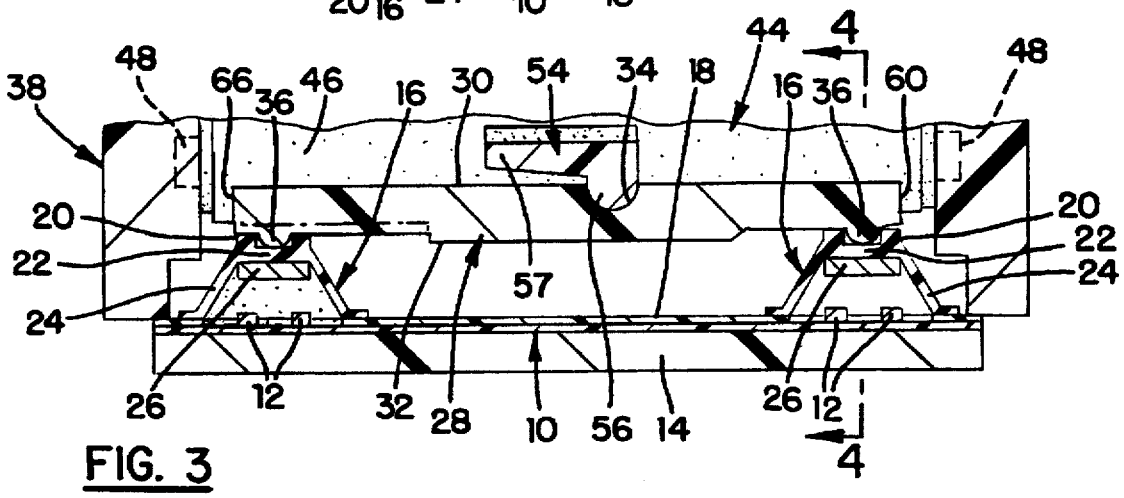
FIG. 3 is a sectional view taken along line 3—3 of FIG. 2.
Figure 4:
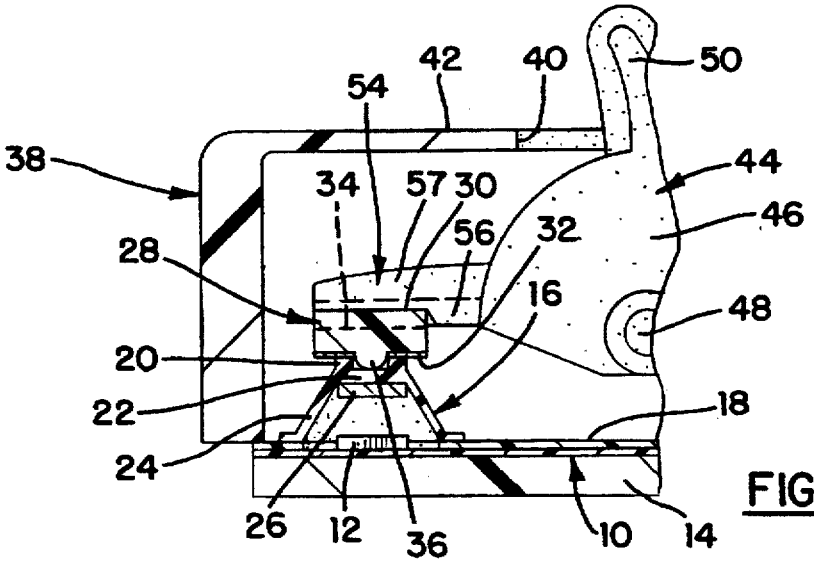
FIGS. 4, 5 and 6 are sectional views illustrating movement of the switch between a first and second forward position.

A switch according to the present invention includes a first substrate 10 such as a flexible circuit having a plurality of spaced apart electrical traces 12 for electrical circuit. A second support substrate 14 may be placed under the flexible circuit 10. Overlying the spaced apart traces are four collapsible dome structures 16 which may be carried by a third substrate 18. Each collapsible dome structure includes an upper relatively thick annular ring portion 20 and a thinner membrane 22 underlining the annular ring portion. A wall 24 extends downwardly from the upper annular ring portion to form the dome structure. Preferably, the dome structure is formed from an elastomer such as silicone. An electrically conductive pellet 26 is secured to the underside of the thin membrane portion and positioned to engage the spaced apart electrical traces 12 when the dome is collapsed thus closing an electrical circuit. As shown in FIG. 1, a switch according to the present invention includes four spaced apart dome structures 16.

Two action bars 28 are provided each having a top surface 30 and a bottom surface 32. Each action bar extends across and bridges two spaced apart dome structures. Each action bar includes an elongated notch 34 or groove formed in the top surface 30 spaced from the middle of the action bar and located closer to a first dome structure than a second dome structure. A dome engagement nub 36 extends downwardly from the bottom surface of the action bar at a location near each end. The dome engagement nub is constructed and arranged to be frictionally received inside the annular ring 20 of the dome structure. A housing 38 overlies the substrate, collapsible domes and action bars. The housing has an opening 40 in an upper surface 42 thereof for receiving a pivotal switch pedal 44. The pivotal switch pedal includes a body portion 46 and a pivot rod 48 extending outwardly from both sides of the body portion to be carried by the housing. A pedestal 50 extends upwardly from the body portion for movement of the switch by an operator. A front engagement bar 52 is located near one end of the body portion and a back engagement bar 54 is located near the other end 54 of the body portion. Each engagement bar includes an elongated tongue 56 and a wing 57 extending horizontally thereform and constructed and arranged to be received in a respective notch or groove 34 formed in the top surface of the action bar. Preferably a stop 58 extends downwardly from the top surface of the housing and is positioned to engage the action bar and prevent the same from falling off of the dome structures.

Figure 5:
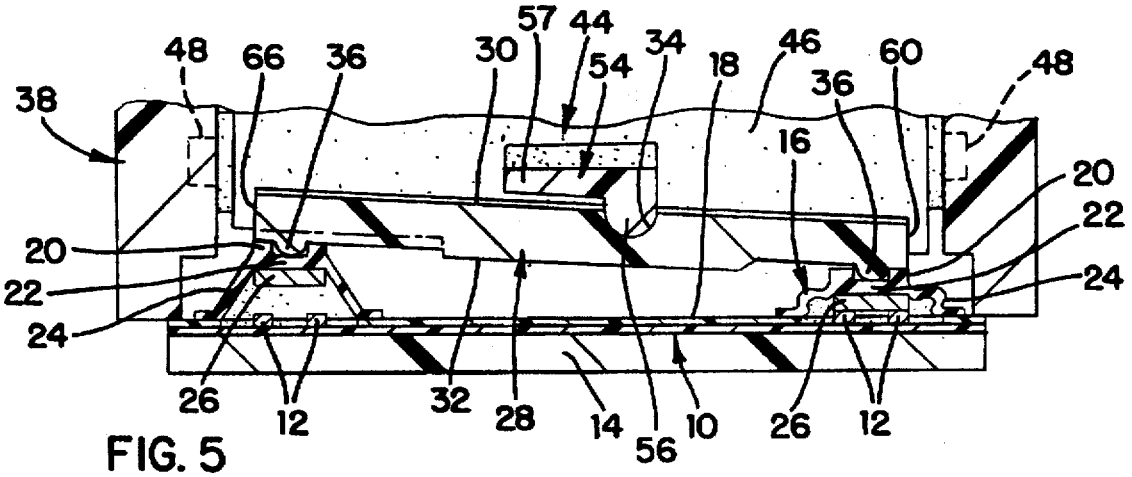
Figure 6:
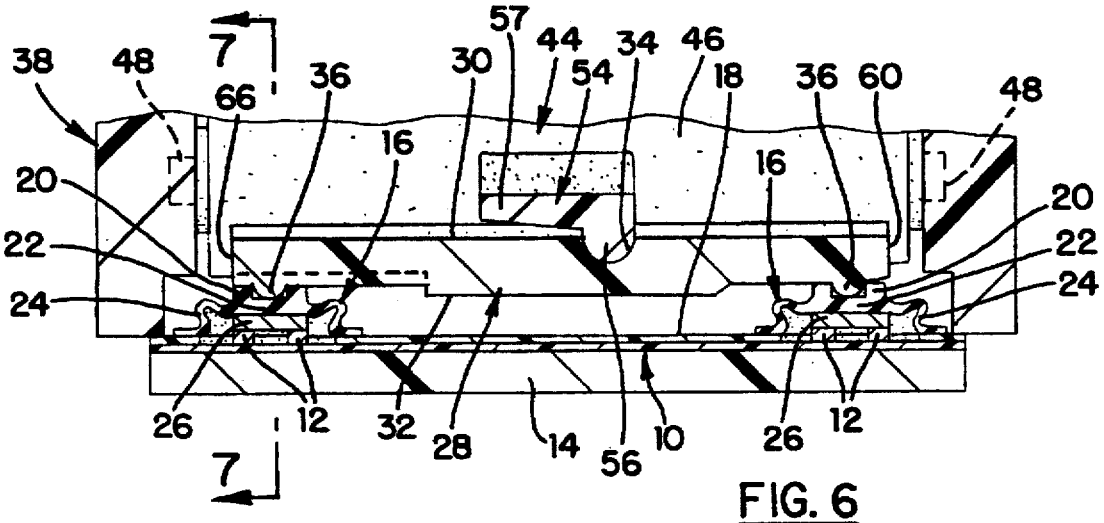

The switch system according to the present invention can be utilized to operate a variety of devices including, such as a automotive power window system. In such a system, the operator pushes the pedestal 50 forward to a first activation position wherein the front (first) engagement bar 52 pushes down on the activation bar 28 causing it to pivot towards a first dome structure 16, closest to the engagement bar tongue 56, and collapsing the first dome structure (FIG. 5). In the first activation position an operator can raise the power window selective amounts as desired. As the operator pushes the pedestal 50 still further forward using more force to a second activation position, the engagement bar wing 57 which extends toward the second dome structure applies pressure to the activation bar causing the activation bar to pivot towards the second dome structure and collapsing the second dome structure while the first dome structure remains collapsed (FIG. 6). In the second activation position, both dome structures are collapsed each closing a circuit and sending a signal to a device such as a CPU which then activates a motor to causes the window to go up automatically on an express basis until the window is closed. The CPU detects the order in that the domes are collapsed and activates the motor accordingly.

Figure 7:
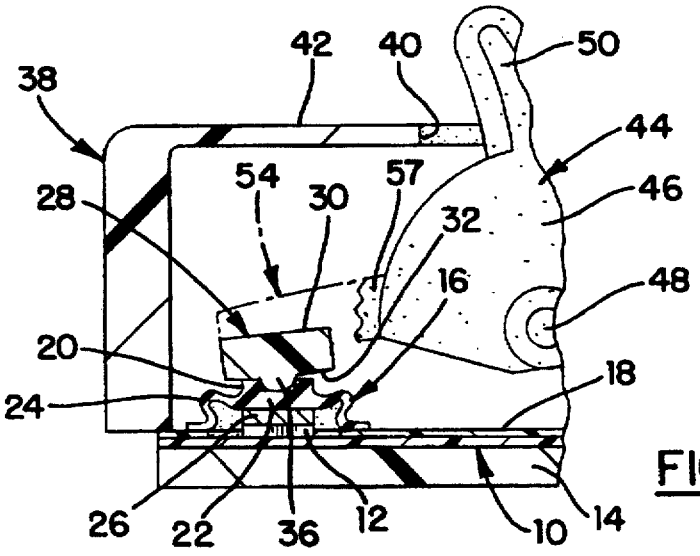
FIG. 7 is a partial sectional view illustrating movement of the switch between a first and second back position.
Figure 8:
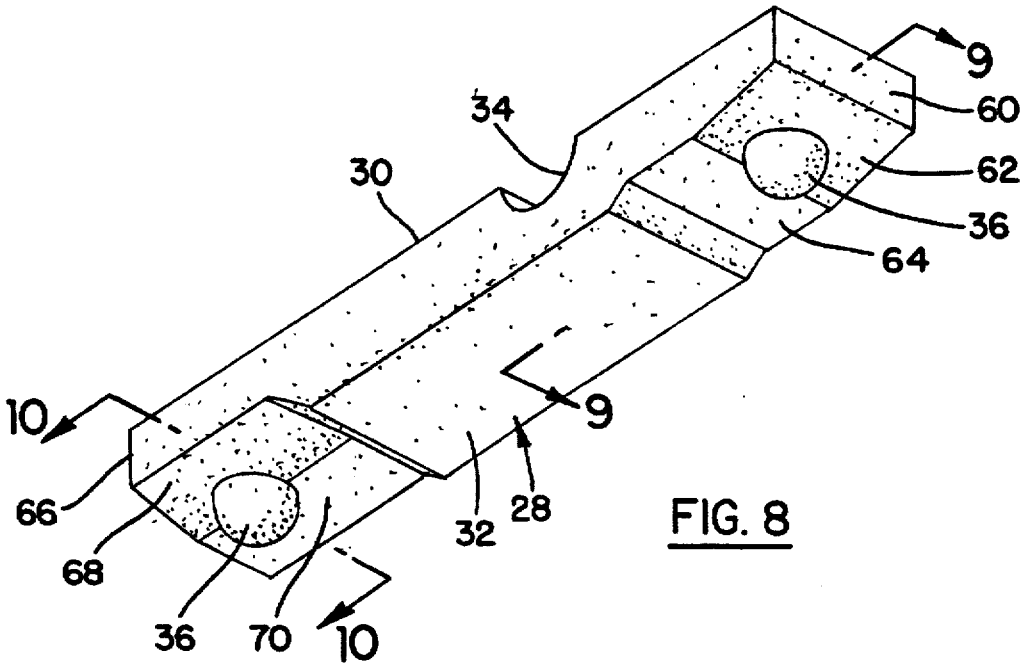
FIGS. 8–10 illustrate the beveled edges on the action bar of the present invention.
Figure 9:
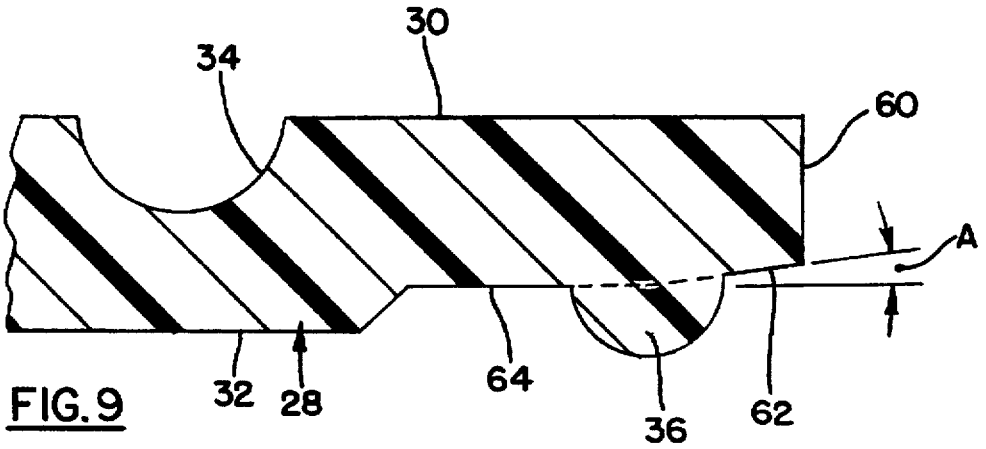
Figure 10:
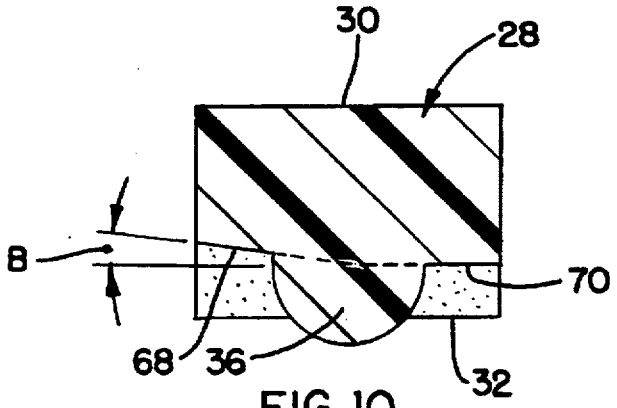

To further aid in the operation of the switch, the bottom action bar near a first end 60 closest to the notch 34 has a first beveled surface 62 formed at an angle A to an adjacent flat surface 64 which runs parallel to the longitudinal axis of the action bar. The first beveled surface 62 engages the annular ring 20 to prevent the first dome from collapsing in a lopsided fashion (FIG. 5). The angle A may range from 1 to 4 degrees. The bottom action bar near a second (opposite) end 66 furthest from the notch 34 includes a second beveled surface 68 formed at an angle B to a second flat surface 70 running perpendicularly to the longitudinal axis of the action bar. The second beveled surface 68 engages the annular ring 20 to prevent the second dome from collapsing in a lopsided fashion (FIG. 7). The angle B may range from 1 to 4 degrees.

Likewise, the operator can move the pedestal backwards to a third position in which the rear (second) engagement bar engages the second action bar causing the third dome structure, which is closest to the rear (second) engagement bar, to collapse. When the operator moves the pedestal still further backwards, additional force is applied to the second activation bar causing the activation bar to pivot towards the fourth dome structure and collapsing the same. In this fourth activation position, both the third and fourth dome structures are collapsed closing associated circuits underneath and sending a signal to a device such as a CPU. Again, the CPU detects the order that the domes are collapsed and then activates a motor causing the window to move down automatically on an express basis until it is completely opened.

As can be appreciated, the present invention eliminates unwanted tilting of the action bar due to asymmetrical loading of the action bar and/or eliminates lopsided collapse of the dome structures.

What is claimed is:

1. An electrical switch comprising a substrate having at least two sets of spaced apart electrical traces, a collapsible dome structure for each set of spaced apart electrical traces and overlying the same, said collapsible dome structure including an upper annular ring and a membrane underlining the annular ring, a wall extending downwardly from the annular ring, an electrically conductive element secured to the underface of the membrane and constructed and arranged to engage the spaced apart electrical traces upon collapse of the dome structure to close the circuit, and wherein said annular ring and said thin membrane define a depression in the top of the dome structure, an elongated action bar overlying a pair of spaced apart dome structures, said action bar having a top surface and a bottom surface, and a first elongated notch formed in the top surface at a location closer to a first dome structure and a first engagement nub extending downwardly from the bottom surface of the action bar and positioned to be frictionally received in the recess formed in the top of the first dome structure and a second engagement nub extending downwardly from the bottom face of the action bar and constructed and arranged to be frictionally received in the recess formed in the top of a second dome structure, a keycap having a body portion and a front engagement bar extending outwardly therefrom, a portion of the front engagement bar being positioned to be received in the first elongated notch formed in the top surface of the action bar upon selectively movement of the keycap, said keycap being movable to a first activation position causing the action bar to pivot towards to first dome structure and collapsing the first dome structure, and said keycap being movable to a second forward activation position causing the action bar to pivot towards to second dome structure and collapsing the second dome structure, and wherein said keycap is movable in the direction perpendicular to a longitudinal axis of each action bar.

2. A switch as set forth in claim 1 wherein said first notch is elongated and positioned in a position perpendicular to the longitudinal axis of the action bar.

3. A device as set forth in claim 1 wherein said engagement bar is an elongated structure and engages the action bar in a direction perpendicular to the longitudinal axis of the action bar.

4. A device as set forth in claim 1 further comprising third and fourth pairs of spaced apart electrical traces and a third and fourth collapsible dome structure associated therewith, each dome structure comprising an annular ring and an underlying thin membrane, a wall extending downward from the annular ring, and an electrically conductive element secured to the underside of the thin membrane and positioned to engage the spaced apart electrical traces, and further comprising a second action bar having a top and bottom face and having a second elongated notch formed in the top surface and positioned closer to the third dome structure, and a third engagement nub extending downward from the bottom face of the second action bar and positioned for frictional engagement in the recess defined in the top of the third dome structure, and a fourth engagement nub extending downward from the bottom face of the action bar for frictional engagement in the recess defined in the fourth dome structure, and further comprising a rear engagement bar extending outwardly from the body portion of the keycap and having a portion of the rear engagement bar positioned to be received in the second notch formed in the top surface of the second action bar upon selective movement of the keycap and wherein said keycap is movable to a third position in which the rear extending engagement bar engages the second notch in the top of the second action bar causing the second action bar to pivot towards the third dome structure and collapsing the same, and said keycap being movable to a fourth position causing said second action bar to pivot towards said fourth dome structure and collapsing the fourth dome structure while the third dome structure remains collapsed.

5. An electrical switch as set forth in claim 1 wherein the portion of the front engagement bar to be received in the notch includes a downwardly extending elongated tongue.

6. An electrical switch as set forth in claim 5 wherein said engagement bar includes a wing extending horizontally from said tongue for engaging the top surface of the action bar when said keycap is moved to the second forward position.

7. An electrical switch as set forth in claim 1 wherein the bottom of the action bar includes a first beveled surface near an end of the bar closest to the notch, said first beveled surface engaging the annular ring preventing the first dome from collapsing in a lopsided fashion when said first dome is collapsed.

8. An electrical switch as set forth in claim 1 wherein the bottom of the action bar includes a second beveled surface near a second end furthest from the notch, said second beveled surface engaging the annular ring preventing the second dome from collapsing in a lopsided fashion when the second dome is collapsed.

* * * * *